US009140052B2

(12) United States Patent
Stanislavsky

(10) Patent No.: US 9,140,052 B2
(45) Date of Patent: Sep. 22, 2015

(54) DECORATIVE INSERT FOR A WINDOW

(71) Applicant: VINYL-PRO WINDOW SYSTEMS INC., Vaughan (CA)

(72) Inventor: Igor Stanislavsky, Vaughan (CA)

(73) Assignee: VINYL-PRO WINDOW SYSTEMS INC., Vaughan, Ontario (CA)

( * ) Notice: Subject to any disclaimer, the term of this patent is extended or adjusted under 35 U.S.C. 154(b) by 0 days.

(21) Appl. No.: 14/460,611

(22) Filed: Aug. 15, 2014

(65) Prior Publication Data

US 2015/0143761 A1 May 28, 2015

Related U.S. Application Data

(63) Continuation-in-part of application No. 29/473,973, filed on Nov. 27, 2013.

(51) Int. Cl.

| | |
|---|---|
| ***E06B 3/964*** | (2006.01) |
| ***E06B 3/66*** | (2006.01) |
| ***E06B 3/663*** | (2006.01) |
| ***E06B 3/673*** | (2006.01) |

(52) U.S. Cl.

CPC ..... *E06B 3/6604* (2013.01); *E06B 3/66304* (2013.01); *E06B 3/67326* (2013.01)

(58) Field of Classification Search

CPC . E06B 3/6604; E06B 3/66304; E06B 3/6675; E06B 3/685; E06B 3/6733; E06B 3/68; B32B 17/10036; E04F 13/0871

See application file for complete search history.

(56) References Cited

U.S. PATENT DOCUMENTS

| | | | | | |
|---|---|---|---|---|---|
| 1,709,267 | A | * | 4/1929 | Horton | 52/204.61 |
| 3,226,903 | A | * | 1/1966 | Lillethun | 52/172 |
| 3,308,593 | A | | 3/1967 | Smith | |
| 4,318,946 | A | | 3/1982 | Pavone | |
| 4,619,850 | A | * | 10/1986 | Charlton | 428/38 |
| 4,652,472 | A | | 3/1987 | Davies | |
| 4,783,938 | A | | 11/1988 | Palmer | |
| 5,099,626 | A | * | 3/1992 | Seeger | 52/314 |
| 5,306,535 | A | | 4/1994 | Shaffer | |
| 5,418,021 | A | | 5/1995 | Kim | |
| 5,447,761 | A | | 9/1995 | Lafond | |
| 5,494,715 | A | | 2/1996 | Glover | |
| 5,501,888 | A | * | 3/1996 | Hanson et al. | 428/38 |
| 5,657,590 | A | * | 8/1997 | Digman et al. | 52/204.61 |
| 5,806,272 | A | | 9/1998 | Lafond | |
| 5,980,667 | A | * | 11/1999 | Reeder et al. | 156/109 |
| 6,035,602 | A | | 3/2000 | Lafond | |

(Continued)

FOREIGN PATENT DOCUMENTS

| | | |
|---|---|---|
| CA | 861838 | 1/1971 |
| CA | 861839 | 1/1971 |
| CA | 2514175 | 1/2007 |

*Primary Examiner* — Brian Glessner
*Assistant Examiner* — Gisele Ford
(74) *Attorney, Agent, or Firm* — Bereskin & Parr LLP/S.E.N.C.R.L., s.r.l.

(57) ABSTRACT

A decorative insert is positionable between a pair of glazing panes of a windows and includes a decorative element. At least a first spacer connector extends from the decorative element for securing the decorative element to a spacer of the window. The first spacer connector includes at least one plate positionable between the spacer and one of the glazing panes. At least a first muntin connector extends from the decorative element for securing the decorative element to a first muntin bar of the window. The first muntin connector includes a protrusion securable to the first muntin bar by friction fit.

20 Claims, 5 Drawing Sheets

(56) References Cited

U.S. PATENT DOCUMENTS

| | | | | |
|---|---|---|---|---|
| 6,128,871 | A * | 10/2000 | Corey | 52/204.61 |
| 6,131,356 | A * | 10/2000 | Gieseke | 52/656.5 |
| 6,272,801 | B1 | 8/2001 | Suh | |
| 6,301,843 | B1 * | 10/2001 | Silverman | 52/204.5 |
| 6,528,131 | B1 | 3/2003 | Lafond | |
| 6,581,341 | B1 | 6/2003 | Baratuci et al. | |
| 6,598,282 | B2 | 7/2003 | Robles Gil-Bueno | |
| 6,761,946 | B2 | 7/2004 | Corapi | |
| 6,935,078 | B1 * | 8/2005 | Benkel | 52/204.69 |
| 7,370,425 | B1 * | 5/2008 | Gieseke | 33/32.3 |
| 8,304,051 | B2 | 11/2012 | Town | |
| 2002/0050115 | A1 | 5/2002 | Reeder et al. | |
| 2002/0104273 | A1 * | 8/2002 | Trpkovski | 52/172 |
| 2004/0123557 | A1 * | 7/2004 | Hornung et al. | 52/786.13 |
| 2004/0216402 | A1 * | 11/2004 | Folsom et al. | 52/204.53 |
| 2006/0026914 | A1 * | 2/2006 | Schultz | 52/204.61 |
| 2006/0112654 | A1 * | 6/2006 | Reichert | 52/202 |
| 2006/0162281 | A1 * | 7/2006 | Pettit et al. | 52/786.13 |
| 2007/0000195 | A1 | 1/2007 | Garces et al. | |
| 2007/0157544 | A1 * | 7/2007 | Zurn et al. | 52/734.2 |
| 2007/0169427 | A1 * | 7/2007 | Lee et al. | 52/204.61 |
| 2007/0193188 | A1 * | 8/2007 | Garay | 52/656.5 |
| 2008/0040995 | A1 * | 2/2008 | Briese et al. | 52/204.61 |
| 2008/0066411 | A1 * | 3/2008 | Tyler | 52/456 |
| 2008/0155914 | A1 * | 7/2008 | Schlabach | 52/211 |
| 2008/0163572 | A1 * | 7/2008 | Lee et al. | 52/204.61 |
| 2008/0172958 | A1 * | 7/2008 | Tyler et al. | 52/204.62 |
| 2008/0196259 | A1 * | 8/2008 | Gieseke | 33/32.3 |
| 2009/0056264 | A1 * | 3/2009 | Rosskamp et al. | 52/456 |
| 2009/0158677 | A1 * | 6/2009 | Liang et al. | 52/204.62 |
| 2010/0146883 | A1 * | 6/2010 | Benkel | 52/204.64 |
| 2011/0067334 | A1 * | 3/2011 | Catalano | 52/456 |
| 2011/0131903 | A1 * | 6/2011 | Ifko | 52/204.61 |

* cited by examiner

DECORATIVE INSERT FOR A WINDOW

This application is a Continuation-in-Part of U.S. Design patent application Ser. No. 29/473,973, filed on Nov. 27, 2013 on behalf of Igor STANISLAVSKY, the disclosure of which is incorporated herein by reference in its entirety.

FIELD

The disclosure relates to decorative inserts for windows. More specifically, the disclosure relates to decorative inserts that may be positioned between a pair of glazing panes of a window and secured to a spacer of the window and a muntin bar of the window.

BACKGROUND

U.S. Pat. No. 6,415,579 (Reeder et al.) purports to disclose a non-metal window muntin formed from plastic or wood for use in hermetically sealed insulated glass windows. The process for forming the muntin includes machining polystyrene sheets which are painted with a latex painT and baked prior to use between sealed glass of the window.

U.S. Pat. App. Pub. No. 2007/0000195 (Garces et al.) purports to disclose a decorative lattice that simulates the look and feel of decorative ironwork by combining carving techniques and coating techniques. The decorative latticework is made of a sheet material such as a composite wood/fiber board material. The decorative lattice is suitable for a mass customization manufacturing processes.

SUMMARY

The following summary is intended to introduce the reader to various aspects of the applicant's teaching, but not to define any invention.

According to one aspect, a window glazing unit includes a first glazing pane and a second glazing pane parallel and opposed to the first glazing pane. The first and second glazing panes are spaced apart by a glazing gap. A spacer is disposed in the glazing gap and extends about the periphery thereof. At least a first muntin bar is positioned between the first and second glazing panes and is secured to the spacer. A decorative insert is positioned between the first and second glazing panes. The decorative insert includes a decorative element, at least a first spacer connector extending from the decorative element and securing the decorative element to the spacer, and at least a first muntin connector extending from the decorative element and securing the decorative element to the first muntin bar.

According to another aspect, a decorative insert is positionable between a pair of glazing panes of a window. The decorative insert includes a decorative element. At least a first spacer connector extends from the decorative element for securing the decorative element to a spacer of the window. The first spacer connector includes at least one plate positionable between the spacer and one of the glazing panes. At least a first muntin connector extends from the decorative element for securing the decorative element to a first muntin bar of the window. The first muffin connector includes a protrusion securable to the first muntin bar by friction fit.

The decorative element, first spacer connector, and first muntin connector may be integrally formed. The decorative element, first spacer connector, and first muntin connector may be integrally formed from a plastic. The decorative element, first spacer connector, and first muntin connector may be integrally formed from nylon.

The decorative insert may further include a second spacer connector. The first spacer connector may extend from the decorative element in a first direction for securing the decorative element to a horizontal portion of the spacer. The second spacer connector may extend from the decorative element in a second direction transverse to the first direction for securing the decorative element to a vertical portion of the spacer.

The decorative insert may include a first set of spacer connectors extending from the decorative element in the first direction, and a second set of spacer connectors extending from the decorative element in the second direction. The first spacer connector may be part of the first set, and the second spacer connector may be part of the second set.

The protrusion may extend generally parallel to the first spacer connector. The protrusion may include a tongue receivable in the muntin bar and securable therein by friction fit.

The decorative insert may further include a second muntin connector for securing the decorative element to a second muntin bar of the window. The first muntin connector may extend from the decorative element in a first direction for securing the decorative element to the first muntin bar. The second muntin connector may extend from the decorative element in a second direction transverse to the first direction for securing the decorative element to the second muntin bar.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
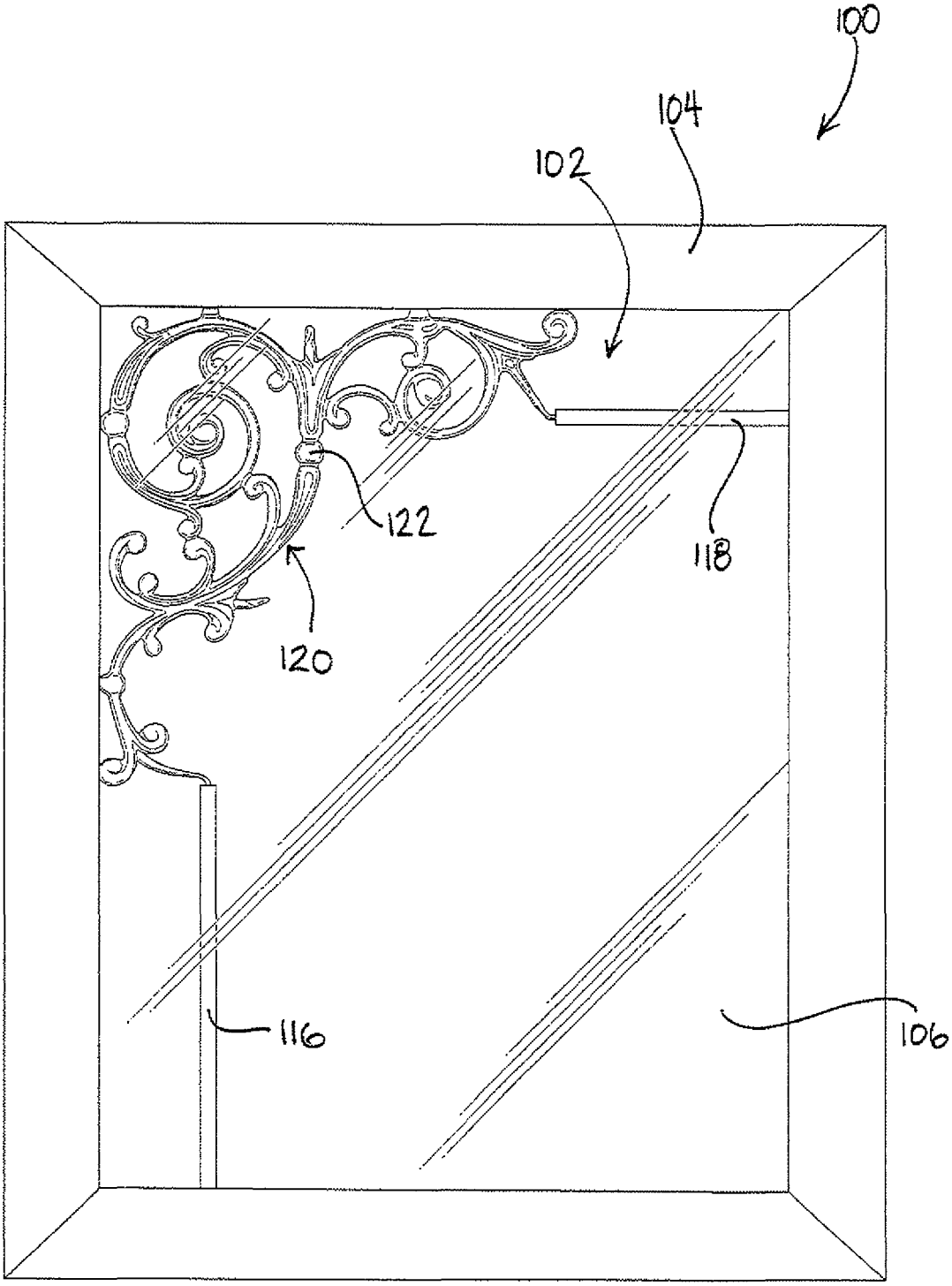
FIG. 1 is a front plan view of a window including an example decorative element.

Referring to FIG. 1, an example of a window 100 is shown. The window 100 includes a glazing unit 102, mounted in a window frame 104. The window frame 104 may be any suitable window frame, and may include a glass stop, which secures the glazing unit 102 to the frame.

Figure 2:
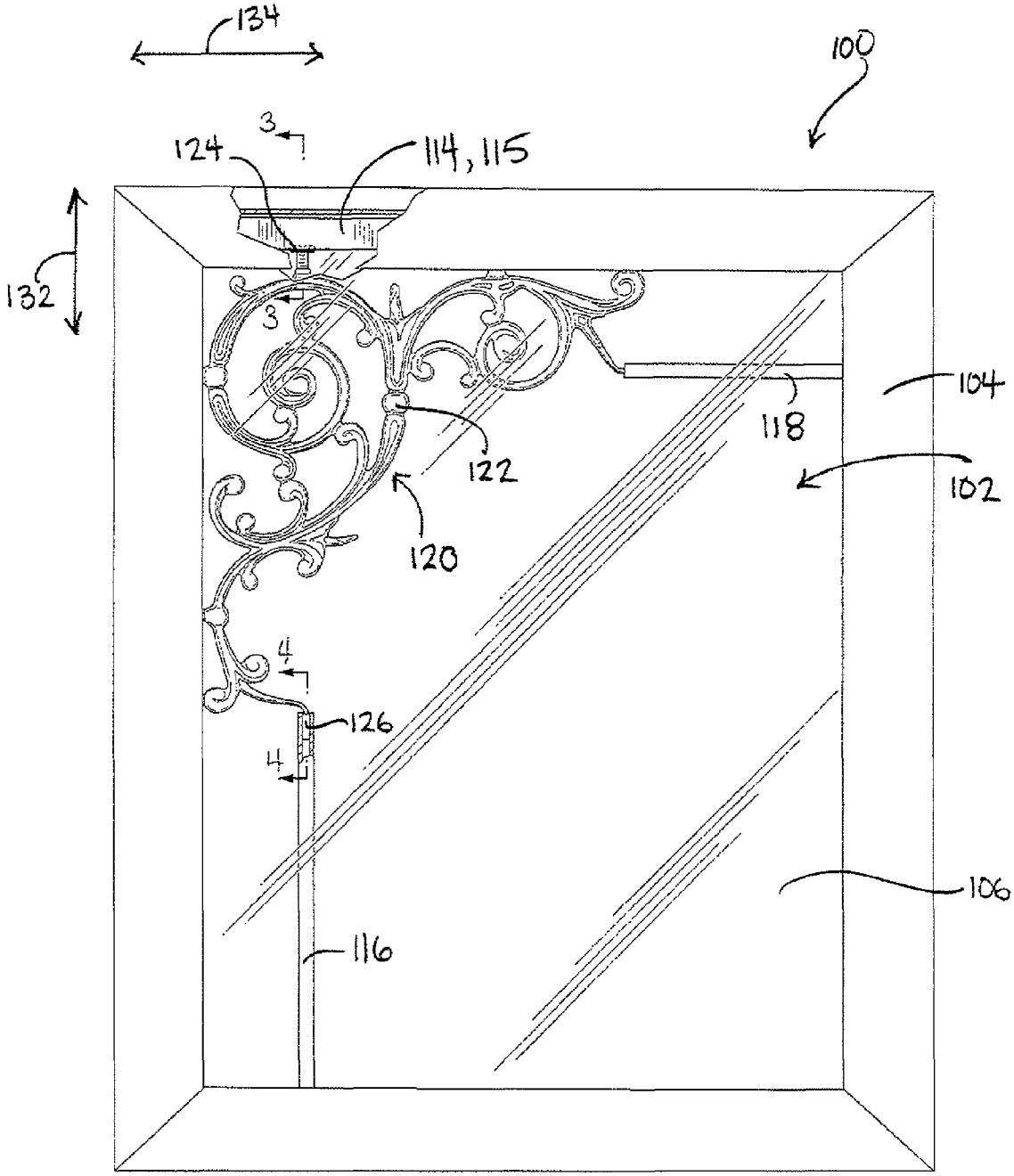
FIG. 2 is the front plan view of FIG. 1, with a portion of the window frame cut away to show a spacer connector of the decorative element, and a portion of a muntin bar cut away to show a muntin connector of the decorative element.
Figure 3:
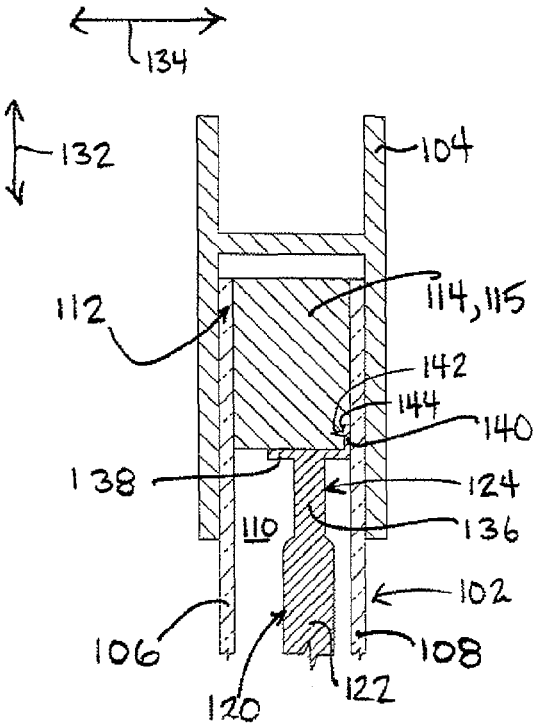
FIG. 3 is a cross-section taken along line 3-3 in FIG. 2.
Figure 4:
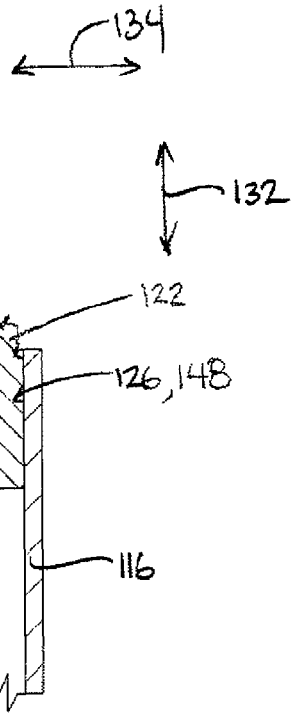
FIG. 4 is a cross-section taken along line 4-4 in FIG. 2.

Referring to FIGS. 2 to 4, the glazing unit 102 includes a first glazing pane 106 and a second glazing pane 108 (also referred to as a pair of glazing panes). The first 106 and second 108 glazing panes are parallel and opposed to each other, and are spaced apart by a glazing gap 110. The first and second glazing panes 106, 108 have a periphery 112, and a spacer 114 is disposed in the glazing gap and extends about the periphery 112. The spacer 114 may be any suitable spacer, and may be a spacer only, or a combination seal and spacer. For example, the spacer 114 may be, but not limited to, a butyl strip such as a swiggle strip, or an inner foam strip having an outer butyl seal. In the example shown, the spacer 114 includes a first horizontal portion 115 at the top of the window 100, a second opposed horizontal portion (not shown) at the bottom of the window, and first and second opposed vertical portions (not shown) along the sides of the window.

Referring to FIGS. 2 and 4, the window 100 may include at least a first muntin bar 116 positioned between the pair of glazing panes 106, 108. In the example shown, the window 100 includes a first muntin bar 116, which is generally vertically extending, and a second muntin bar 118, which is generally horizontally extending. The muntin bars 116, 118 may in some examples be generally hollow extruded lineals. The muntin bars 116, 118 may be secured between the pair of glazing panes 106, 108 in any suitable fashion. For example, the muntin bars 116, 118 may be secured to the spacer by a muntin clip. The muntin bars 116, 118 may be provided in order to create an aesthetic affect.

Referring still to FIG. 2, the window 100 further includes a decorative insert 120 positioned between the pair of glazing panes 106, 108, for providing an aesthetic effect to the window 100. The decorative insert 120 may be secured to the spacer 114 and the muntin bars 116, 118, in order to generally fix the decorative insert 120 in position between the pair of glazing panes 106, 108, as will be described in further detail below. The decorative insert 120, either on its own or together with the muntin bars 116, 118, may simulate the appearance of iron such as wrought iron.

Figure 5:
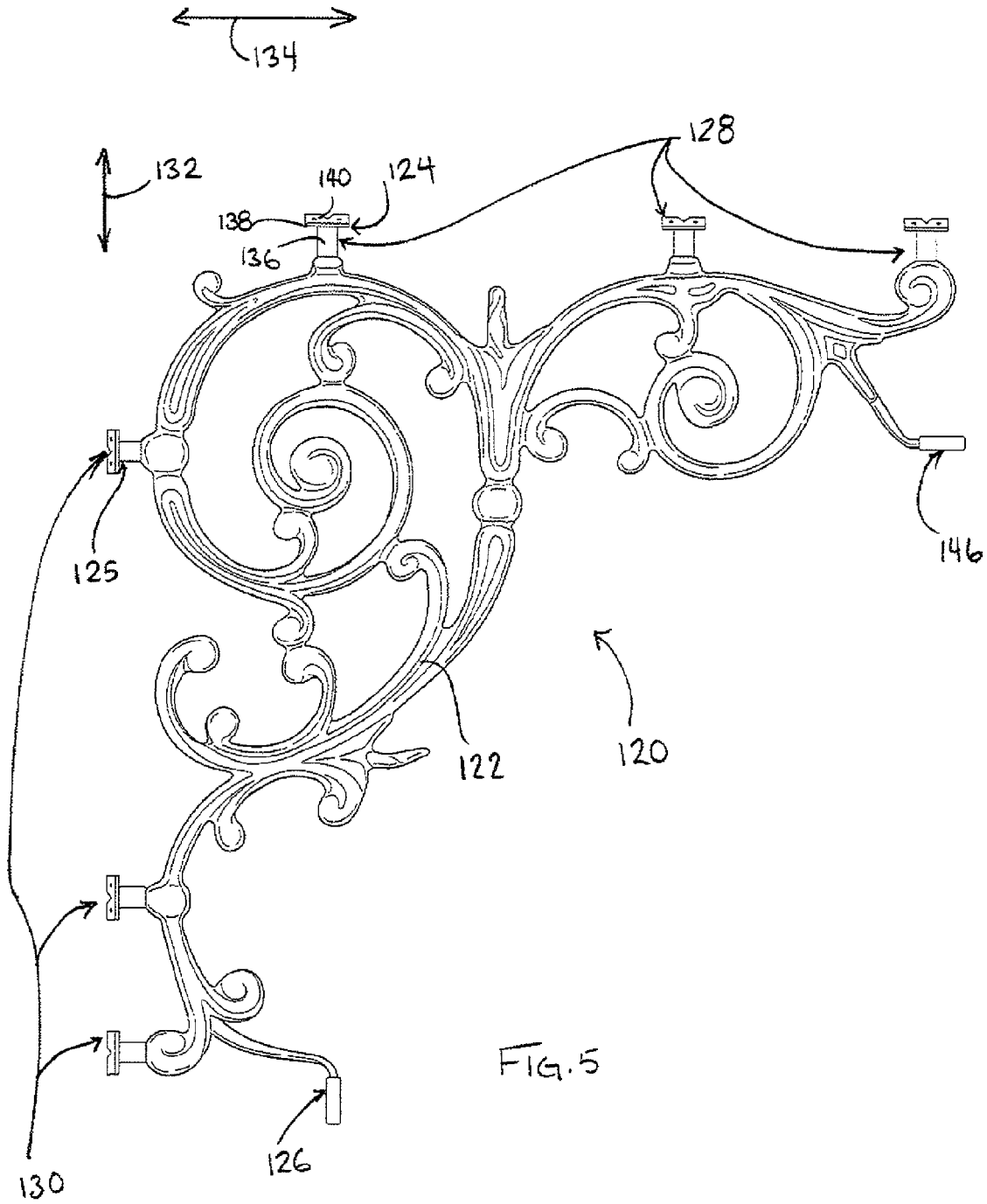
FIG. 5 is a front plan view of the decorative element of FIG. 1.
Figure 6:
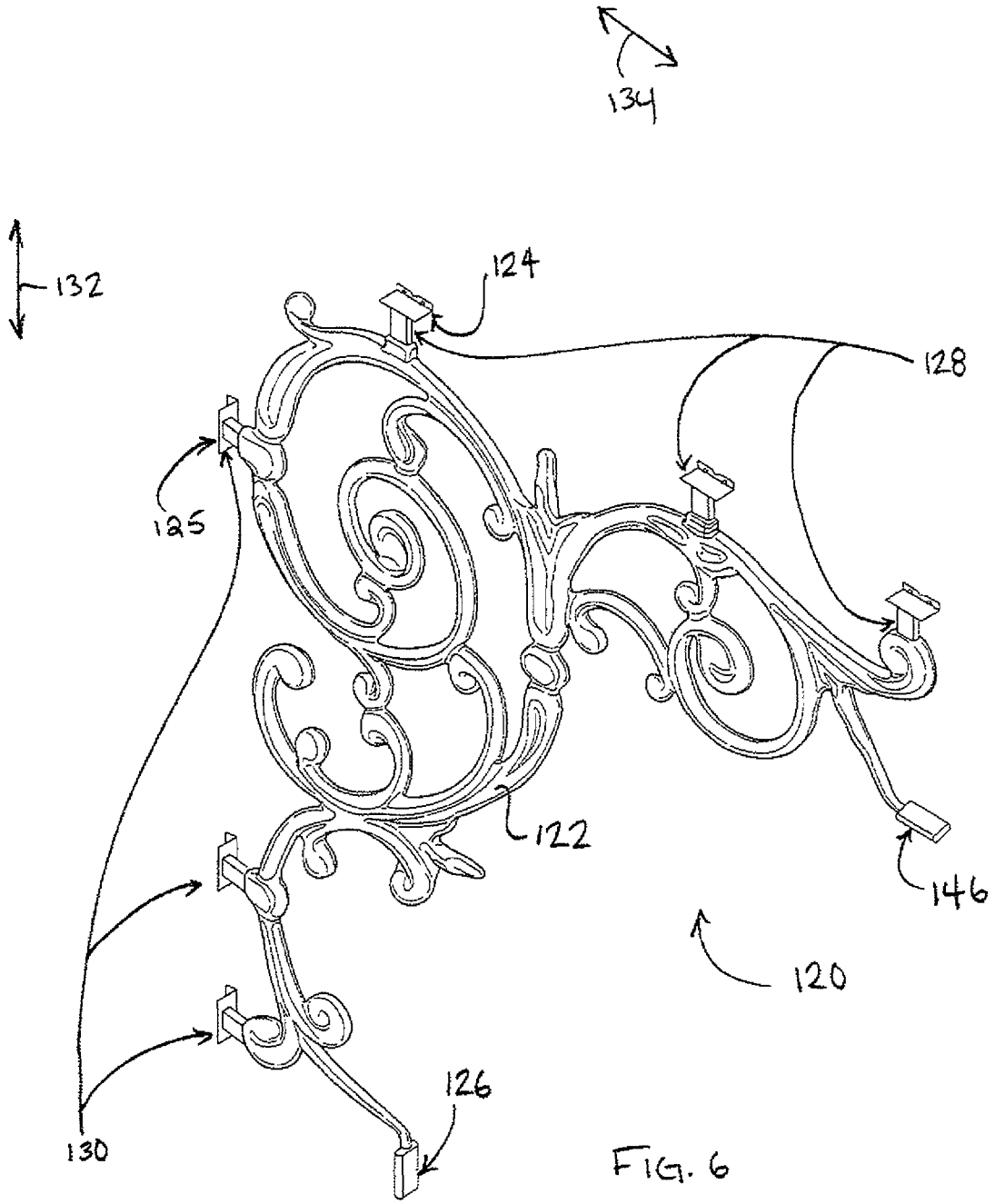
FIG. 6 is a perspective view of the decorative element of FIG. 1.

Referring to FIGS. 5 and 6, the decorative insert 120 includes a decorative element 122 for providing the aesthetic affect, at least a first spacer connector 124 extending from the decorative element 122 for securing the decorative element 122 to the spacer 114, and at least a first muntin connector 126 extending from the decorative element 122 for securing the decorative element 122 to the first muntin bar 116.

In the example shown, the decorative element 122 generally includes the portion of the decorative insert 120 that is visible when the window is viewed in front plan view (as shown in FIG. 1).

Referring to FIGS. 5 and 6, the decorative element 122 may be of any design that provides an aesthetic effect. In the example shown, the decorative element 122 includes a series of interconnected scrolls and curves. In alternative examples, the decorative element may be of another design, such as but not limited to a grid or criss-cross pattern, a floral design, an image, or lettering. Furthermore, in the example shown, the decorative element is generally shaped to fit or nest within a corner of the window frame 104. In alternative examples, the decorative element may be shaped to fit elsewhere. For example, the decorative element may be shaped to run along one side of the window frame, or to fit centrally within the window frame.

As mentioned above, the decorative insert 120 includes at least a first spacer connector 124 extending from the decorative element 122 for securing the decorative element 122 to the spacer 114. In some examples, the decorative insert 120 may include only the first spacer connector 124. In alternative examples, the decorative insert 120 may further include additional spacer connectors, such as a second spacer connector 125 or subsequent spacer connectors. The second 125 or subsequent spacer connectors may extend in the same direction as the first spacer connector 124, or in a different direction from the first spacer connector 124. Referring now to FIGS. 5 and 6, in the example shown, the decorative insert 120 includes a first set 128 of spacer connectors, and a second set 130 of spacer connectors. The first set 128 of spacer connectors extends from the decorative element 122 in a first direction 132, which in the example shown is generally vertical. The second set 130 of spacer connectors extends from the decorative element 122 in a second direction 134 that is generally transverse to the first direction 132, and in the example shown is generally horizontal. The first set 128 of spacer connectors secures the decorative element 122 to the first horizontal portion 115 of the spacer 114 (shown in FIG. 2), and the second set 130 of spacer connectors secures the decorative element 122 to the first vertical portion (not shown) of the spacer 114.

The first spacer connector 124 will now be described in detail. The additional spacer connectors in the example shown are similar to the first spacer connector 124, and for simplicity, will not be described in detail herein.

The spacer connector 124 may generally include at least one plate positionable between the spacer and one of the glazing panes. Referring to FIGS. 3 and 5, in the example shown, the first spacer connector 124 includes an arm 136 extending generally outwardly from the decorative element 122. A base plate 138 is positioned at the outer end of the arm 136, and is orthogonal to the arm. A side plate 140 extends outwardly from one side of the base plate 138, and is orthogonal to the base plate 138. A pair of teeth 142 (shown in FIG. 3) extend from an inside side face 144 of the side plate 140, and extend generally parallel to the base plate 138. Referring to FIG. 3, in use, the base plate 138 abuts the spacer 114, the side plate 140 is positioned between the spacer 114 and the second glazing pane 108, and the teeth 142 are inserted into and/or grip the spacer 114, to connect the decorative element 122 to the spacer 114.

In alternative examples, the spacer connector(s) may be of another configuration, and/or may be connected to the spacer in another manner. For example, another number of teeth may be provided on the side plate, and/or the side plate may be positioned between the spacer and the first glazing pane or the side plate may be omitted and the base plate may be adhered to the spacer.

As mentioned above, the decorative insert 120 includes at least a first muntin connector 126 extending from the decorative element 122 for securing the decorative element 122 to the spacer 114. Referring to FIGS. 5 and 6, in the example shown, the decorative insert 120 includes a first muntin connector 126 for connecting the decorative element 122 to the first muntin bar, and a second muntin connector 146 for connecting the decorative element 122 to the second muntin bar 118.

Referring still to FIGS. 5 and 6, in the example shown, the muntin connectors 126, 146 each include a protrusion 148, 150, respectively. The protrusion 148 of the first muntin connector 126 extends in the first direction 132, generally parallel to the first spacer connector 124 and first muntin bar 116. The protrusion 150 of the second muntin connector 146 extends in the second direction 134, generally parallel to the second spacer connector 125 and the second muntin bar 118. The protrusions 148, 150 are securable to the first muntin bar 116 and second muntin bar 118, respectively, by friction fit. More specifically, referring to FIG. 4, in the example shown, the protrusion 148 of the first muntin connector 126 is a tongue that is receivable in the first muntin bar 116 and securable therein by friction. The protrusion 150 of the second muntin connector 146 is a tongue that is receivable in the second muntin bar 118 and securable therein by friction.

In alternative examples, the muntin connectors may be of another configuration. For example, the muntin connectors may include a protrusion that defines a notch. The muntin bars may be insertable into the notches and securable therein by friction.

In some examples, the decorative insert 120 (i.e. the decorative element, spacer connectors, and muntin connectors) may be integrally formed. For example, the decorative insert 120 may be integrally formed from a plastic such as nylon. In one specific example, the decorative insert 120 is integrally formed from Nylon 6-6. This material may provide the decorative insert 120 with UV resistant properties.

In the example shown, the window 100 includes one decorative insert 120 and two muntin bars 116, 118. In other examples, the window 100 may include another number of decorative inserts and muntin bars. For example, a window may include four decorative inserts (e.g. one positioned at each corner) and four muntin bars. For further example, a window may include two decorative inserts (e.g. positioned at diagonally opposite corners or adjacent corners), and four muntin bars.

While the above description provides examples of one or more processes or apparatuses, it will be appreciated that other processes or apparatuses may be within the scope of the accompanying claims.

The invention claimed is:

1. A decorative insert positionable between a pair of glazing panes of a window, the decorative insert comprising:

a) a decorative element;

b) at least a first spacer connector extending from the decorative element for securing the decorative element to a spacer of the window, the first spacer connector comprising at least one plate positionable between the spacer and one of the glazing panes, the first spacer connector extending from the decorative element in a first direction for securing the decorative element to a horizontal portion of the spacer; and c) a second spacer connector extending from the decorative element in a second direction transverse to the first direction for securing the decorative element to a vertical portion of the spacer; and d) at least a first muntin connector extending from the decorative element for securing the decorative element to a first muntin bar of the window, the first muntin connector comprising a protrusion securable to the first muntin bar by friction fit;

wherein the decorative insert comprises a first set of spacer connectors extending from the decorative element in the first direction, and a second set of spacer connectors extending from the decorative element in the second direction, and the first spacer connector is part of the first set, and the second spacer connector is part of the second set.

2. The decorative insert of claim 1, wherein the decorative element, the first spacer connector, and the first muntin connector are integrally formed.

3. The decorative insert of claim 1 wherein the decorative element, the first spacer connector, and the first muntin connector are integrally formed from a plastic.

4. The decorative insert of claim 1, wherein the decorative element, the first spacer connector, and the first muntin connector are integrally formed from nylon.

5. The decorative insert of claim 1, wherein the protrusion extends generally parallel to the first spacer connector.

6. The decorative insert of claim 1, wherein the protrusion comprises a tongue receivable in the first muntin bar and securable therein by friction fit.

7. The decorative insert of claim 1, wherein the decorative insert further comprises a second muntin connector for securing the decorative element to a second muntin bar of the window.

8. The decorative insert of claim 7, wherein a) the first muntin connector extends from the decorative element in the first direction for securing the decorative element to the first muntin bar; and b) the second muntin connector extends from the decorative element in the second direction for securing the decorative element to the second muntin bar.

9. A window glazing unit comprising:

a) a first glazing pane and a second glazing pane parallel and opposed to the first glazing pane, the first and second glazing panes spaced apart by a glazing gap;

b) a spacer disposed in the glazing gap and extending about a periphery thereof;

c) at least a first muntin bar positioned between the first and second glazing panes and secured to the spacer; and d) a decorative insert positioned between the first and second glazing panes, the decorative insert comprising a decorative element, at least a first spacer connector and a second spacer connector extending from the decorative element and securing the decorative element to the spacer, and at least a first muntin connector extending from the decorative element and securing the decorative element to the first muntin bar;

wherein the first spacer connector extends from the decorative element in a first direction and is secured to a horizontal portion of the spacer, the second spacer connector extends from the decorative element in a second direction transverse to the first direction and is secured to a vertical portion of the spacer; and wherein the decorative insert comprises a first set of spacer connectors extending from the decorative element in the first direction, and a second set of spacer connectors extending from the decorative element in the second direction, and the first spacer connector is part of the first set, and the second spacer connector is part of the second set.

10. The window glazing unit of claim 9, wherein the first spacer connector comprises at least one plate positioned between the spacer and the first glazing pane.

11. The window glazing unit of claim 9, wherein the first muntin connector comprises a protrusion secured to the first muntin bar by friction fit.

12. The window glazing unit of claim 9, wherein the decorative insert is integrally formed.

13. The window glazing unit of claim 9 wherein the decorative element, the first spacer connector, and the first muntin connector are integrally formed from a plastic.

14. The window glazing unit of claim 9, wherein the decorative element, the first spacer connector, and the first muntin connector are integrally formed from nylon.

15. The window glazing unit of claim 9, wherein the first muntin connector extends generally parallel to the first spacer connector.

16. The window glazing unit of claim 9, wherein the first muntin connector comprises a tongue received in the first muntin bar and secured therein by friction fit.

17. The window glazing unit of claim 9, wherein the decorative insert further comprises a second muntin connector securing the decorative element to a second muntin bar of the window glazing unit.

18. The window glazing unit of claim 17, wherein a) the first muntin connector extends from the decorative element in the first direction; and b) the second muntin connector extends from the decorative element in the second direction.

19. A decorative insert positionable between a pair of glazing panes of a window, the decorative insert comprising:

a) a decorative element;

b) at least a first spacer connector extending from the decorative element for securing the decorative element to a spacer of the window, the first spacer connector comprising at least one plate positionable between the spacer and one of the glazing panes;

c) at least a first muntin connector extending from the decorative element for securing the decorative element to a first muntin bar of the window, the first muntin connector comprising a protrusion securable to the first muntin bar by friction fit, the first muntin connector extending from the decorative element in a first direction for securing the decorative element to the first muntin bar; and d) a second muntin connector for securing the decorative element to a second muntin bar of the window, the second muntin connector extending from the decorative element in a second direction transverse to the first direction for securing the decorative element to the second muntin bar.

20. A window glazing unit comprising:

a) a first glazing pane and a second glazing pane parallel and opposed to the first glazing pane, the first and second glazing panes spaced apart by a glazing gap;

b) a spacer disposed in the glazing gap and extending about a periphery thereof;

c) at least a first muntin bar and a second muntin bar positioned between the first and second glazing panes and secured to the spacer;

d) a decorative insert positioned between the first and second glazing panes, the decorative insert comprising (i) a decorative element, (ii) at least a first spacer connector and a second spacer connector extending from the decorative element and securing the decorative element to the spacer, wherein the first spacer connector extends from the decorative element in a first direction and is secured to a horizontal portion of the spacer, and the second spacer connector extends from the decorative element in a second direction transverse to the first direction and is secured to a vertical portion of the spacer, and (iii) at least a first muntin connector extending from the decorative element and securing the decorative element to the first muntin bar, wherein the first muntin connector extends from the decorative element in the first direction, and a second muntin connector securing the decorative element to the second muntin bar, wherein the second muntin connector extends from the decorative element in the second direction.

* * * * *